US005593154A

United States Patent [19]

Allen

[11] Patent Number: 5,593,154

[45] Date of Patent: Jan. 14, 1997

[54] BASEBALL TETHENED BALL TRAINING APPARATUS

[76] Inventor: Lance Allen, 6245 Lawton Ave., Las Vegas, Nev. 89107

[21] Appl. No.: 622,187

[22] Filed: Mar. 25, 1996

[51] Int. Cl.[6] ..... A63B 69/00

[52] U.S. Cl. ..... 473/429

[58] Field of Search ..... 273/26 E, 58 C, 273/413

[56] References Cited

U.S. PATENT DOCUMENTS

| | | | |
|---|---|---|---|
| 793,002 | 6/1905 | Martin | 273/413 |
| 824,560 | 6/1906 | Martin | 273/413 |
| 2,243,620 | 5/1941 | Fernandez | 273/58 C |
| 2,751,226 | 6/1956 | Conway | 273/26 E |
| 3,380,738 | 4/1968 | Papp | 273/26 E |
| 5,467,978 | 11/1995 | Paluch | 273/26 E |

*Primary Examiner*—Theatrice Brown

*Attorney, Agent, or Firm*—Quirk & Tratos

[57] ABSTRACT

A baseball is connected by a rope to a swivel at a top end of a pole that has its bottom end anchored to the ground.

7 Claims, 1 Drawing Sheet

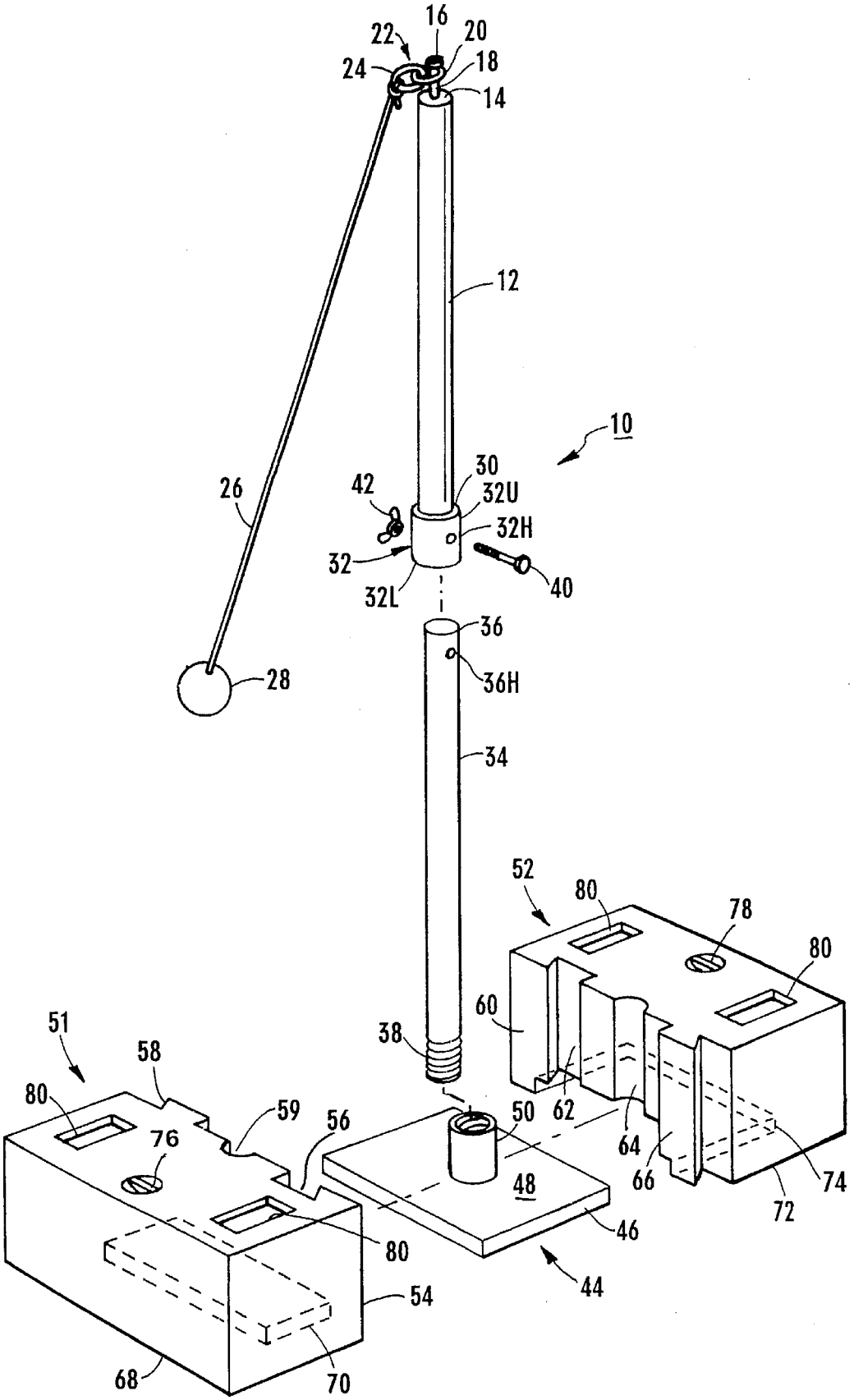
16
22
20
24
18
14
12
10
30
42
32U
26
32H
32
40
32L
36
36H
28
34
52
80
78
80
60
51
38
58
80
59
56
50
62
76
64
48
66
74
72
46
80
44
54
68
70

BASEBALL TETHENED BALL TRAINING APPARATUS

BACKGROUND OF THE INVENTION

1. Field of Invention

This invention relates generally to sports training equipment and, more specifically, to apparatus for training a batter to hit a pitched baseball.

2. Description of the Prior Art

At a spring training camp for a major league baseball team, a familiar sight is a baseball pitching machine that propels a baseball towards a batter. The machine is an effective training and practice device for the batter because it propels the baseball in a manner that substantially replicates the pitching of the baseball by a pitcher. When the batter either hits the baseball or misses the baseball, it is later retrieved for additional use. The retrieval of the baseball is an undesired chore.

It should be appreciated that the machine is typically used in an area substantially larger than the back yard of a little league baseball player, for example, and may require an operator. Additionally, the cost of the machine usually causes it to be unavailable to the little league player.

The little league player usually practices hitting the baseball, while it is stationary, off a device known as a TEE. When the little league player hits the baseball, it is later retrieved for additional use.

Since the baseball is stationary when it is hit off of the TEE, the amount of coordination between the vision and muscular activity of the little league player is limited. The effectiveness of the TEE as a training and practice device is correspondingly limited. Accordingly, there is a need for an inexpensive apparatus that is effective as a training and practice device, is useable in an area of reduced size and obviates the retrieval of the baseball.

SUMMARY OF THE INVENTION

An object of the present invention is to train a batter to hit a pitched baseball.

Another object of the present invention is to provide a baseball batter training apparatus that obviates retrieval of a baseball after it is hit.

Another object of the present invention is to provide a baseball batter training apparatus that is useable in a small area.

Another object of the present invention is to provide a baseball batter training apparatus that is operable by a batter without assistance.

According to the present invention, a ball is connected by a rope to a swivel at the top end of a pole, the bottom end of the pole being anchored to the ground.

The invention provides an inexpensive baseball batter training apparatus that trains the batter to hit a baseball while it is moving. The invention obviates the need to retrieve the baseball after it is hit, is useable in a small area and is operable by the batter without assistance. Additionally the apparatus may be easily assembled and disassembled, thereby enhancing portability.

Other objects, features, and advantages of the invention should be apparent from the following description of the preferred embodiment as illustrated in the accompanying drawing.

BRIEF DESCRIPTION OF THE DRAWING

The sole FIGURE herein is a partial exploded perspective view of the preferred embodiment of the present invention.

DESCRIPTION OF THE PREFERRED EMBODIMENT

As shown in the drawing, a baseball batter training apparatus is comprised of a cylindrical vertical pole 10 that has an upper section 12 with a top end 14 with a bolt 16 partially screwed therein. Because the bolt 16 is partially screwed in, an unthreaded shank 18 of the bolt 16 extends from the top end 14.

The bolt 16 passes through a link 20 of a chain 22 whereby the chain 22 is rotatable about the shank 18. Since the chain 22 is rotatable about the shank 18, the bolt 16 and the chain 22 form a swivel.

The chain 22 additionally includes a link 24 that is linked to a loop in the proximal end of a rope 26. The loop is maintained by a clamp 28 of any suitable type. Because the chain 22 includes two links, the loop is not abraded by the edge of the top end 14 when the chain 22 swivels about the shank 18. In an alternative embodiment, a chain may include more than two links.

The distal end of the rope 26 is connected to a baseball 28. Preferably, the baseball 28 has a hole (not shown) therethrough along a diameter. The end of the rope 26 is passed through the hole and knotted to maintain the baseball 28 at the distal end of the rope 26.

From the description given hereinbefore, when the batter throws the baseball 28 in a direction substantially tangential to an arcuate path about the pole 10, the swivel causes the baseball 28 to travel along an arcuate path. Moreover, the probability is vanishingly small that the batter can make identical repeated throws of the baseball 28. Therefore the arcuate path is unpredictable.

After the batter throws the baseball 28, she attempts to hit it as it travels along the arcuate path. Since the arcuate path is unpredictable, the coordination between the vision and muscular activity of the batter needed to hit the baseball 28 approximates the coordination needed to hit a baseball during the playing of a game of baseball. It has been experimentally determined that the pole 10 is preferably approximately eight feet in length with the rope 26 being approximately seven feet in length.

A bottom end 30 of the section 12 is fixedly connected within a cylindrical coupling unit 32 at an end 32U thereof. The coupling unit 32 additionally has an end 32L with a diametrical hole 32H therethrough. The section 12 and the coupling unit 32 are coaxial.

A lower section 34 of the pole 10 has a top end 36 with a diametrical hole 36H therethrough. The top end 36 is coaxially insertable within the end 32L. The section 34 additionally has a threaded bottom end 38.

When the top end 36 is inserted, the section 12 is axially rotated relative to the section 34 to bring the holes 32H, 36H into alignment. Thereafter, the shank of a screw 40 is passed through the holes 32H, 36H. The shank of the screw 40 is maintained within the holes 32H, 36H by a wing nut 42 that screws onto the screw 40.

The coupling unit 32, the screw 40 and the wing nut 42 maintain an end-to-end connection of the sections 12, 34. When it is desired to transport the training apparatus, it may be desirable to unscrew the wing nut 42, remove the screw 40 and separate the sections 12, 34.

A base 44 of the training apparatus is comprised of a substantially square base plate 46 with a top surface 48. An internally threaded cylindrical sleeve 50 is fixedly connected to the surface 48 by welding or in any other suitable manner. Moreover, the axis of the sleeve 50 passes perpendicularly through the center of surface 48.

In this embodiment, the end 38 screws into the sleeve 50, thereby connecting the pole 10 to the base 44. When it is desired to transport the training apparatus, it may be desirable to unscrew the end 38 from the sleeve 50.

As explained hereinafter, the training apparatus is anchored by hollow blocks 51, 52 that fit on top of the base 44. The block 51 has a surface 54 with a vertical groove 56 therein that extends to a known depth within the block 51. The width of the groove 56 varies linearly as a function of depth, with the groove 56 narrowest at the surface 54.

The surface 54 includes the outer surface of a tongue 58 that protrudes from the block 51. The shape of the tongue 58 is substantially complementary to the shape of the groove 56. Additionally, near the center of the surface 54 is a semi-cylindrical vertical slot 59 that has a diameter substantially equal to the outside diameter of the sleeve 50.

The block 52 has a surface 60 similar to the surface 54. Additionally, the surface 64 has a groove 62 and a slot 64 respectively similar to the groove 56 and the slot 59. The outer surface of the surface 60 includes the outer surface of a tongue 66 that protrudes from the block 52. The tongue 66 is similar to the tongue 58.

When the training apparatus is assembled, the tongues 58, 66 are respectively fitted into the grooves 12, 56, thereby forming a well known type of tongue in groove arrangement that maintains the surfaces 54, 60 in an abutting relationship. Additionally, the slots 59, 64 substantially form a cylindrical hole that fits about the sleeve 50.

Preferably, a bottom 68 of the block 51 has a rectangular recess 70 therein that extends to the surface 54. Similarly, a bottom 72 of the block 52 has a rectangular recess 74 that extends to the surface 60. When the training apparatus is assembled, the recesses 70, 74 substantially form a space that is complimentary to the base plate 46, whereby the base plate 46 fits into the recesses 70, 74.

The blocks 51, 52 include similar holes (not shown) that are respectively covered by caps 76, 78. Typically, the caps 76, 78 are removed for the purpose of filling the blocks 51, 52 with either water or sand to make the blocks 51, 52 have a weight that is suitable for anchoring the pole 10. The blocks 51, 52 additionally include recessed handles 80 that are used for lifting the blocks 51, 52.

While the invention has been particularly shown and described with reference to a preferred embodiment thereof, it should be understood by those skilled in the art that changes in form and detail may be made therein without departing from the spirit and scope of the invention.

I claim:

1. Apparatus for training a batter to hit a baseball, comprising:

a pole;

a swivel connected to a top end of said pole;

a rope that connects said baseball to said swivel;

a rectangular base plate connected to a bottom end of said pole;

a pair of rectangular blocks that are disposed on top of said base plate, said blocks each having a groove in a side thereof and a tongue that extends therefrom, the tongue of one block being of a shape that is substantially complimentary to the shape of the groove of the other block, and a semi-cylindrical vertical slot.

2. The apparatus of claim 1 wherein said swivel comprises:

a chain;

a bolt that is partially screwed into said top end with a portion of the shank of said bolt extending therefrom, said bolt passing through a link of said chain.

3. The apparatus of claim 2 wherein said chain is comprised of two links, with said rope is connected to one link and said shank passing through the other link.

4. The apparatus of claim 1 wherein said blocks are hollow and adapted to be filled with sand.

5. The apparatus of claim 1 wherein said blocks are hollow and adapted to be filled with water.

6. The apparatus of claim 1 wherein each of said blocks each have a rectangular recess within its bottom surface, said recesses forming a space that is substantially complimentary to the shape of said base plate when the tongue of one block is disposed within the groove of the other block.

7. The apparatus of claim 1 wherein a top section of said pole is removeably connected to a bottom section of said pole.

* * * * *